United States Patent [19]

Nakagawa

[11] Patent Number: 4,958,687

[45] Date of Patent: Sep. 25, 1990

[54] FIRE DAMPER

[75] Inventor: Katsuyoshi Nakagawa, Osaka, Japan

[73] Assignee: Daito Tech Kabushiki Kaisha, Osaka, Japan

[21] Appl. No.: 429,424

[22] Filed: Oct. 31, 1989

[30] Foreign Application Priority Data

Dec. 15, 1988 [JP] Japan ..... 63-162944

[51] Int. Cl.[5] ..... F24F 7/00

[52] U.S. Cl. ..... 169/60; 98/40.25; 236/49.2

[58] Field of Search ..... 169/5, 60; 236/49.1, 236/49.2, 49.3, 49.4, 49.5; 98/40.06, 40.25

[56] References Cited

U.S. PATENT DOCUMENTS

| | | | |
|---|---|---|---|
| 3,436,016 | 4/1969 | Edwards | 98/40.25 |
| 3,912,223 | 10/1975 | Iwata | 169/60 |
| 4,040,304 | 8/1977 | McCabe | 169/60 |
| 4,080,978 | 3/1978 | McCabe | 236/49.2 |
| 4,497,241 | 2/1985 | Ohkata | 98/40.25 |
| 4,697,736 | 10/1987 | Kolt | 98/40.25 |
| 4,817,912 | 4/1989 | McCabe | 236/49.2 |

FOREIGN PATENT DOCUMENTS

| | | |
|---|---|---|
| 61-103156 | 7/1986 | Japan . |
| 63-59659 | 4/1988 | Japan . |

*Primary Examiner*—Sherman Basinger
*Assistant Examiner*—Stephen P. Avila
*Attorney, Agent, or Firm*—Browdy and Neimark

[57] ABSTRACT

A fire damper having a duct, a flap rotatable about an axis crossing the duct, an engaging member, and a spring ordinarily urging the flap to rotate in a direction. The fire damper has a trigger mechanism comprising a leaf spring fixed to the flap and having a free end engageable with the engaging member so as to stop the flap at an angle parallel with air flow. The fire damper further has a heat detecting and actuating member made of form memory alloy spring which has an end fixed with the flap and has another end fixed to the leaf spring at a position near the free end of the leaf spring.

5 Claims, 2 Drawing Sheets

FIRE DAMPER

BACKGROUND OF THE INVENTION

The present invention relates to a fire damper used in an air duct system, and more particularly, to a damper having a shutter plate or flap which rotates to shut the duct when temperature of air flowing through the duct rises to a predetermined height.

There has been known a fire damper employing a temperature fuse as a temperature detecting and actuating element. Generally, such conventional fire damper has a tubular casing to be inserted in a middle way of an air duct of an air ventilation system or the like, a flap provided in the casing in a rotatable manner about an axis extending in the diameter direction of the casing, a spring urging the flap to rotate in a direction to shut the duct, and a trigger member or a stopper mechanism made of a temperature fuse to keep the flap in a rotated state by substantially right angle against urging force of the spring.

And when fire happens, the fuse melts and the flap is rotated by the spring to close the passage of the duct.

However, such conventional type of fire damper has drawbacks that several length of fuses must be prepared for various diameters or widths of ducts, since the fuse is stretched between a lateral periphery of the flap and the inside surface of the duct so as to extend in a radial direction of the duct. In addition, temperature detecting function based on the melting point of the fuse is not stable, and actuating speed based on the melting speed of the fuse is comparatively slow.

In order to improve the temperature detecting function and actuating speed, it has been proposed to employ a coil spring made of form memory alloy, for example, Ti-Ni, Cu-Zn, In-Tl or the like, as a temperature detecting and actuating element. Such fire dampers are disclosed in Japanese Unexamined Utility Model Publications No. 103156/1986 by Sharp Kabushiki Kaisha and No. 59659/1988 by Kabushiki Kaisha Daito Kosakusho who is assignee of the instant application.

The former fire damper has a stopper pin inserted through a hole in a wall of a casing and engaged with a lever fixed to an end of a rotary shaft of a flap. The spopper pin is urged in a disengageable direction by a compression spring, and is ordinary stopped in its engaging state by a somewhat complex trigger mechanism including a coil spring made of form memory alloy. The spring made of form memory alloy has plasticity at a temperature under the metamorphosis point and bacomes to have elasticity at a temperature higher than the metamorphosis point, and then the spring behaves as a compressin spring.

The latter fire damper has another trigger mechanism comprising a trigger lever rotatably supported with a bracket fixed to a duct wall, a tubular member coaxially fixed with a rotary shaft of flap and has a slit engageable with the trigger lever, and a coil spring made of form memory alloy which behaves as a tension spring under heating.

In the proposed fire damper, the trigger lever is generally engaged with the tubuler member to stop the rotation of the flap, and when fire happens the form memory alloy spring rotates the trigger lever to allow rotation of the flap.

Those coil spring made of form memory alloy is sensitive to change of temperature for a special temperature in accordance with the kind of alloy, i.e. for the transform point or metamorphosis point of the alloy, and the shrinking speed is very quick when the temperature changes across the metamorphosis point.

However, the damper has a lot of parts, especially a lot of movable elements, and therefore, the structure is very complex. As a result, breakdown often happens in the damper, and the superior functions of the form memory alloy is not efficiently utilized.

An object of the present invention is to provide a fire damper in which the member of parts is not large so that breakdowns happens less, temperature detecting and actuating function is good, and can be employed in various sizes of ducts.

SUMMARY OF THE INVENTION

According to the present invention, there is provided a fire damper comprising a tubular duct, a flap provided in the duct and supported by the duct in a rotatable manner about an axis crossing the duct and elastically urged in a direction for rotation, a flap-receiver capable of abutting against the urged flap, a leaf spring having a base end fixed to the flap and a free end engageable with the flap-receiver so as to stop the flap in a rotated angle, and a heat detecting and actuating member made of form memory alloy which has an end fixed with the flap and has another end fixed to a position near the free end thereof so that the member deforms the leaf spring when the member shrinks under heating. When a fire happen, the form memory alloy spring quickly shrinks and, provides elastic deformation of the leaf spring, and therefore, the engagement between the free end of the leaf spring and the flap-receiver. Then, the flap is rotated to shut the duct.

BRIEF DESCRIPTION OF DRAWINGS

Hereinafter, a preferable embodiment of a fire damper of the present invention is described with reference to the accompanying drawings in which.

DETAILED DESCRIPTION OF THE INVENTION

Figure 1:
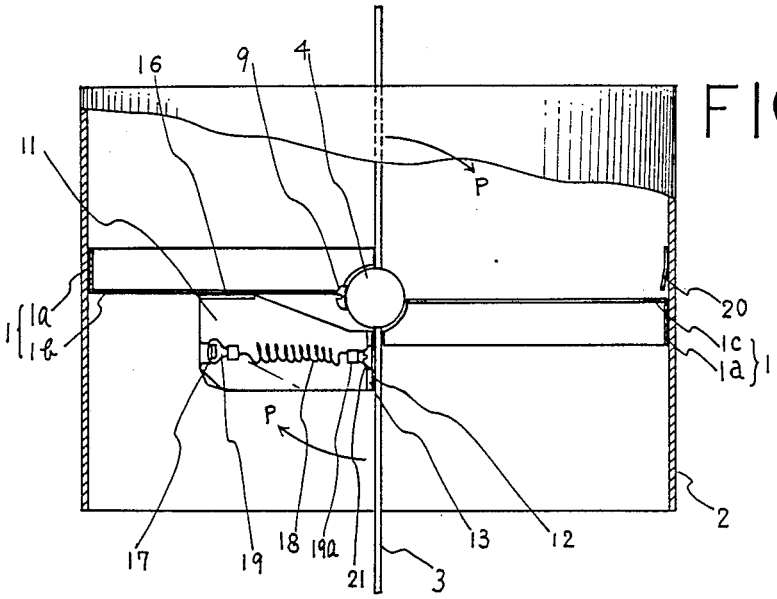
FIG. 1 is a partially cut away plan view showing an embodiment of a fire damper of the present invention.
Figure 4:
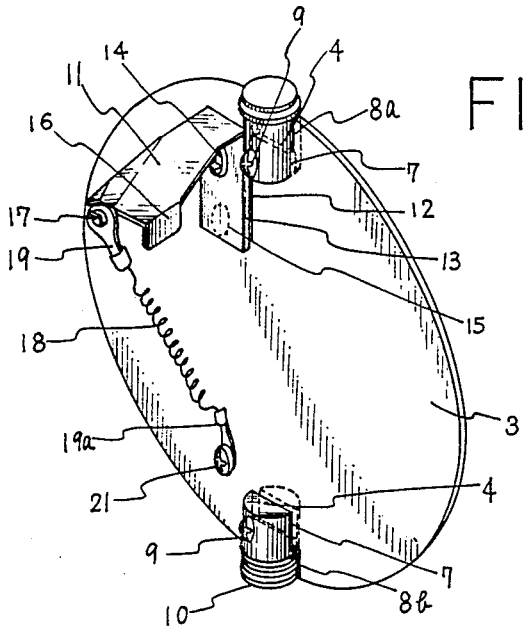
FIG. 4 is a perspective view of a flap of the damper in FIG. 1.
Figure 2:
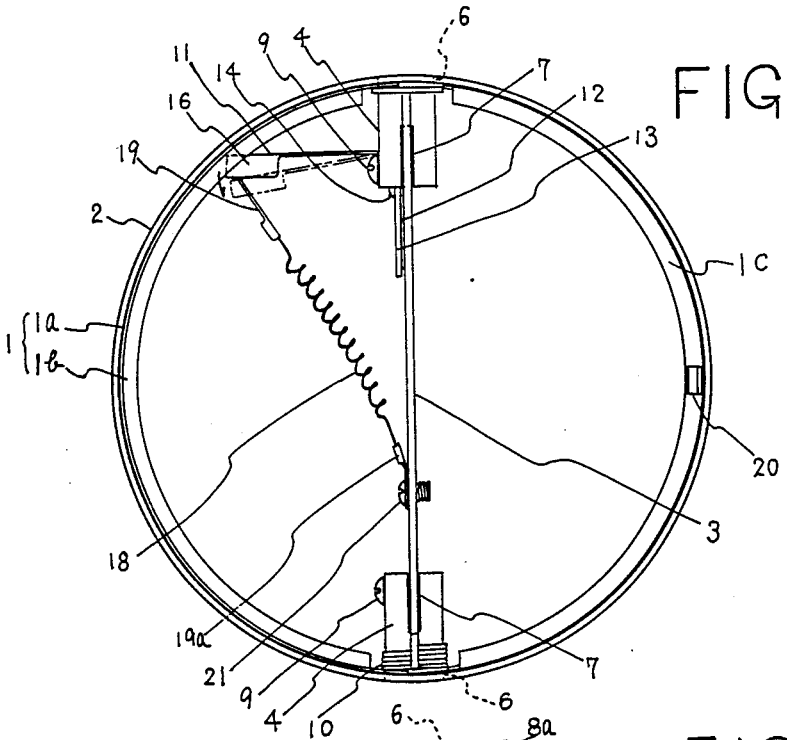
FIG. 2 is a front view showing the fire damper of FIG. 1.
Figure 3:
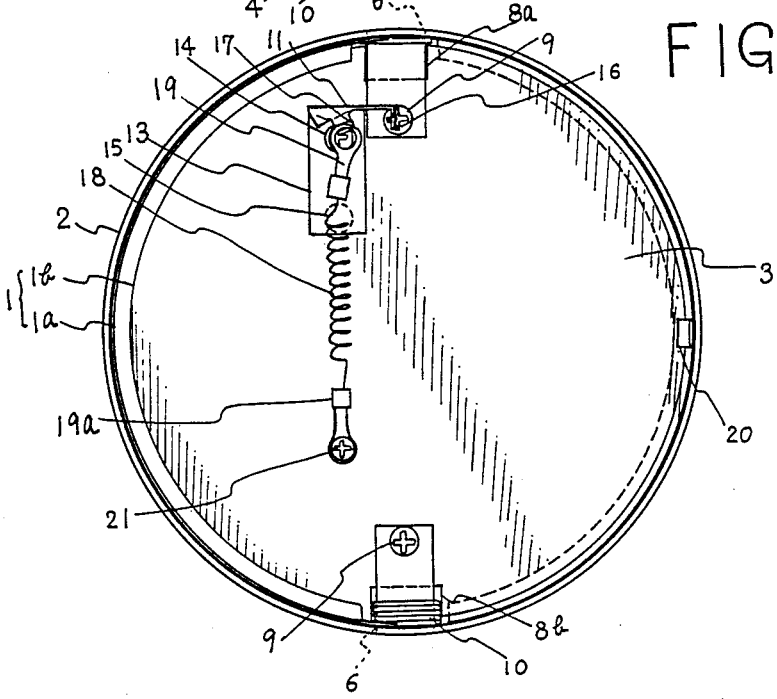
FIG. 3 is a front view showing the fire damper of FIG. 1 when the flap shuts the duct.

Referring to FIGS. 1 and 2, a fire damper comprises a cylindrical casing or duct 2 and a disc-like flap 3 rotatable in the duct about an axis along a diameter thereof. The duct 2 is provided with a pair of flap receivers 1 each of which has semi-ring shape with an L-shaped cross section. The rim portions 1*a* of the flap receivers are spot-welded on the inside surface of the duct 2. One of flange portions 1*b* is shifted from the other 1*c* by a thickness of the flap 3 so that the flap 3 can take a posture perpendicular with the axis of the duct when the flap 3 is rotated to abut against the flap-receivers 1.

The flap 3 has a pair of shafts 4 each of which is rotatably supported by a hole 6 formed in the duct 2. The shafts 4 are arranged on a diameter of the flap 3, and the holes 6 are arranged on a diameter of the duct 2. Each shaft 4 has a slit 7 having a gap corresponding to the thickness of the flap 3. The flap 3 has a pair of cut-off portions 8*a*, 8*b*, and each shaft 4 is engaged with the flap 3 by inserting an edge of the cut-off portion 8*a*, 8*b* into the slit 7 and by fixing them with a screw 9 or the like.

One of the cut off portion 8*a* has a width corresponding to the diameter of the shaft 4, and another cut-off portion 8*b* has a width slightly wider than the diameter of the shaft 4. Therefore, a pair of side gaps are provided between one of the shaft and side edges of the cut off portion 8*b*. A twisting coil spring 10 is provided around the shaft 4 by utilizing the gaps. An end of the spring 10 is fixed to the duct 2 and another end is fixed to the shaft 4, respectively. Therefore, the flap is ordinary urged to rotate toward a shut posture.

Next, a stopper mechanism or trigger mechanism employing a form memory alloy which is an important feature of the present invention will be explained.

An L-shaped leaf spring 11 is fixed to the flap 3, for example, by holding a base portion 12 of the leaf spring 11 at a position near the shaft 4 by means of a hold plate 13, a screw 14 and a spot-welded portion 15. The leteral side edge of the leaf spring 11 is provided with a finger 16 capable of engaging with the flange portion 1*b* of the flap-receiver 1. The finger 16 is preferably formed by bending a side-edge of the leaf spring at a position near the free end thereof. Further, the free end is provided with a hook 17 and is slightly deflected so as to rub with an inside edge of the flap-receiver 1.

An end of a heat-detecting and actuating member 18 having a coil-spring shape made of form memory alloy is engaged with the hook 17 by means of an eye-end 19. Another end is fixed to the flap 3 at a position near the shaft 4 by means of an eye-end 19*a* and a screw 21.

The ends of the member 18 ( hereinafter referred to as form memory alloy spring ) has plasticity and is easily expanded when the temperature is lower than predetermined metamorphosis ( transform ) point, for example, 70~90° C. ( preferably about 70° C. ), but becomes elastic to obtain a shrinking force capable of elastically deforming the leaf spring 5 as shown in FIG. 2 by phantom lines.

The above-mentioned form memory alloy can be selected from Ti-Ni or the like. In addition, a stopper 20 made of resilient metal sheet is preferably fixed on an inside surface of the duct 2. The stopper 20 can stop the flap 3 after the flap 3 rotates to the shutting posture in order to prevent counter rotation of the flap 3.

Hereinafter, function and operation of the above-mentioned embodiment of the fire damper are explained.

At ordinary condition, i.e. fire does not happen, temperature of air flow in the duct is low, and temperature of the form memory alloy spring 18 is also lower than the metamorphosis point. Therefore, the leaf spring 11 is engaged with the flap-receiver 1, and the flap 3 is in a posture parallel with the air flow.

When fire happens, temperature of the air flow in the duct 2 rises, and the temperature of the form memory alloy spring 18 also rises to a high-temperature phase. Then, the form memory alloy spring 18 shrinks to the original dense coiled state. At that instant, the free end of the leaf spring 11 is pulled in the inside direction, i.e. shrinking direction of the form memory alloy spring 18 and is deformed against elasticity thereof. Then, the finger 16 of the leaf spring 11 is disengaged from the flap-receiver 1.

As a result, the flap 3 is rotated clockwise by the twisting coil as shown by arrow P in FIG. 1. Then, the flap 3 shuts the duct 2 while deforming the stopper 20 outwardly and abuts against the flap receivers 1.

After the flap 3 is rotated beyond the stopper 20, the flap 3 cannot be rotated counter-clockwise direction since the twisting spring 10 still urges the flap 2 in the clockwise direction, and in addition, the stopper 20 stops the flap 3 from rotation.

As is mentioned above, though the fire duct of the present invention has a simple construction and the function thereof is very simple and reliable, since the leaf spring 5 which is a stopper of the flap 3 is directly operated by a form memory alloy spring 18.

Though in the above mentioned embodiment, the duct has cylindrical shape and the flap has a disk-like shape, a duct and a flap having another shape, e.g. a rectangular sectional shape, of course, can be employed in the present invention. Also, instead of the flap-receiver, another stopper member can be employed for engaging with the side edge of the leaf spring.

Further, though a prefered embodiment is described with referring attached drawings, the present invention is not limited to the above embodiment, and various changes and modifications can be made without apparting from the scope and spirit of the invention.

What we claim is

1. A fire damper comprising:
   - a duct;
   - a flap provided in the duct and supported by the duct in a rotatable manner about an axis crossing the duct and urged elastically in a rotating direction;
   - a leaf spring an end of which is fixed to the flap;
   - an engaging member capable of engaging with the leaf spring so as to stop rotation of the flap; and
   - a heat detecting and actuating element made of form memory alloy which has an end fixed with the flap and has another end fixed to the leaf spring at a position near a free end thereof so that the member deforms the leaf spring when the member shrinks under heating.

2. The fire damper of claim 1, wherein the heat detecting and actuating member has a shape of coil spring.

3. The fire damper of claim 1, wherein the engaging member is one of flap-receivers capable of receiving periphery of the flap when the flap is rotated to shut the duct.

4. The fire damper of claim 1, further comprising a one-directional stopper fixed on an inside surface of the duct, to stop the flap from rotation after the flap abuts against the flap-receivers.

5. The fire damper of claim 1, wherein the form memory alloy has a metamorphosis point at 70° to 90° C.

* * * * *